United States Patent [19]

Wilson

[11] Patent Number: 4,551,213

[45] Date of Patent: Nov. 5, 1985

[54] RECOVERY OF GOLD

[75] Inventor: Alex T. Wilson, Tucson, Ariz.

[73] Assignee: Duval Corporation, Houston, Tex.

[21] Appl. No.: 607,713

[22] Filed: May 7, 1984

[51] Int. Cl.[4] ..... C25R 1/20

[52] U.S. Cl. ..... 204/111; 204/130; 75/101 R; 75/104; 75/109; 75/112; 75/114; 75/118 R; 210/767; 210/805; 210/807

[58] Field of Search ..... 75/104, 111–114, 75/118 R, 109, 101 R; 204/109, 111, 130; 210/767, 807, 805

[56] References Cited

U.S. PATENT DOCUMENTS

| | | | |
|---|---|---|---|
| 47,497 | 4/1865 | Ott | 75/101 R |
| 75,293 | 3/1868 | Ott | 75/101 R |
| 138,500 | 5/1873 | Kallmes | 75/101 R |
| 490,193 | 1/1893 | French | 75/101 R |
| 589,959 | 9/1897 | Crooke | 75/101 R |
| 607,287 | 7/1898 | Sinding-Larsen | 75/101 R |
| 629,856 | 8/1899 | Hoepfner | 75/101 R |
| 674,594 | 5/1901 | Best | 75/101 R |
| 730,462 | 6/1903 | Kendall | 75/101 R |
| 811,085 | 1/1906 | Pohle | 75/101 R |
| 927,046 | 7/1909 | Hogel | 75/101 R |
| 1,049,746 | 1/1913 | Malm | 75/101 R |
| 1,185,817 | 6/1916 | Malm | 75/101 R |
| 1,238,298 | 8/1917 | Johnson | 75/101 R |
| 1,368,885 | 2/1921 | Bradford | 75/101 R |
| 1,818,846 | 8/1931 | Giles | 75/101 R |
| 1,883,234 | 2/1929 | Lennox et al. | 75/101 R |
| 2,750,265 | 6/1956 | Hadsel | 23/285 |
| 3,761,369 | 9/1973 | Tirrell | 204/108 |
| 3,767,760 | 10/1973 | Hougen et al. | 423/22 |
| 3,785,944 | 1/1974 | Atwood et al. | 204/107 |
| 3,798,026 | 3/1974 | Milner et al. | 75/104 |
| 3,879,272 | 4/1975 | Atwood et al. | 204/107 |
| 3,880,653 | 4/1975 | Hougen | 75/101 R |
| 3,901,776 | 8/1975 | Kruesi et al. | 204/107 |
| 3,972,711 | 8/1976 | Goens et al. | 75/117 |
| 3,975,189 | 8/1976 | Haugen | 75/101 R |
| 3,979,265 | 9/1976 | Fonseca | 204/105 R |
| 4,013,457 | 3/1977 | Goens et al. | 75/104 |
| 4,039,324 | 8/1977 | Stephens, Jr. et al. | 75/72 |
| 4,204,922 | 5/1980 | Fraser et al. | 204/109 |
| 4,230,487 | 10/1980 | Demarthe et al. | 75/118 R |
| 4,266,972 | 5/1981 | Redondo-Abad et al. | 75/101 R |
| 4,337,128 | 6/1982 | Haakonsen et al. | 75/118 R |
| 4,342,592 | 8/1982 | Lamb | 75/118 R |
| 4,378,275 | 3/1983 | Adamson et al. | 75/118 R |
| 4,439,235 | 3/1984 | Simpson | 75/118 R |

OTHER PUBLICATIONS

Kruesi et al., "Pay Dirt", Oct. 23, 1972, pp. 4–10.

*Primary Examiner*—R. L. Andrews

*Attorney, Agent, or Firm*—Lowe, King, Price & Becker

[57] ABSTRACT

Gold values are recovered from mixtures thereof contained with sulfur, especially mixtures obtained from the hydrometallurgical processing of copper. The process comprises the following steps:

(a) forming an aqueous suspension of the mixture containing the gold and sulfur values;

(b) adjusting the chloride concentration of the suspension so that the suspension contains at least about 12 weight percent of chloride;

(c) maintaining the oxidation reduction potential of the mixture in the range of about 650–750 millivolts;

(d) adding cupric chloride or ferric chloride, if not already present in the mixture, in sufficient amounts to cause the gold contained in the mixture to dissolve into the solution; and (e) recovering the gold from the solution in an electrolytic cell, or by reaction with carbon.

16 Claims, 3 Drawing Figures

OXIDATION REDUCTION POTENTIAL vs TIME
NUMBERS ILLUSTRATED ON THE CURVE REPRESENT
THE CORRESPONDING PHE
TEMP. 60°C: SOLID TO LIQUID 1/3
OXIDATION REDUCTION POTENTIAL (M.V.)
750
700
650
600
550
500
TIME (HOURS)
1
2
3
4
5
502
490
483.3
472.9
456.3
434
426
423
419
417
414

RECOVERY OF GOLD

FIELD OF THE INVENTION

This invention relates to methods for the recovery of elemental gold from mixtures containing the gold, and more particularly relates to methods for the recovery of elemental gold from mixtures which contain sulfur and other impurities such as copper.

BACKGROUD OF THE INVENTION

As a precious metal, and because of its economic value, many methods are available to recover gold from mixtures with other minerals by a variety of procedures. In many mixtures, the gold is obtained in admixture with other materials so that it is very difficult to recover. A particular area in which the gold is difficult to recover involves mineral mixtures obtained from copper mining and processing. Gold is often contained as a significant component of such mixtures. It is, however, often difficult to recover the gold because of the presence of the other materials which react with the gold or with the reagent used to recover the gold.

A particular area in which significant amounts of gold may be found are the mixtures obtained from hydrometallurgical processes for treatment of copper concentrates which provide a residue mixture after recovery of the copper. These residue mixtures usually contain elemental sulfur as well as significant amounts of other components including copper as well as the gold. It has not been economically feasible to recover the gold by a cyanide process, for example, because the sulfur reacts with the cyanide thus causing an economically unacceptable consumption of cyanide. Similarly, if chlorine is used to recover the gold, the chlorine reacts with the sulfur. There is, however, a substantial body of art concerned with the use of chlorides or chlorine in the recovery of gold from ores which contain sulfur. Thus, in U.S. Pat. No. 1,883,234, sodium chloride is added to a sulfur containing zinc ore followed by a roast by which the chlorides of metals including gold are driven off. In U.S. Pat. Nos. 490,193, 730,462, 1,049,746, 1,238,298, 2,750,265 and 3,767,760, gold and other precious metals are extracted from sulfur and copper containing ores by the use of free chlorine gas to remove these materials as their chlorides. In U.S. Pat. No. 47,497, there is disclosed the use of hypochlorous acid for the recovery of gold from pyrites containing gold. In U.S. Pat. No. 3,979,265, sulfur monochloride is used for gold extraction, and in U.S. Pat. No. 811,085, gold values are recovered from sulfide ores which also contain copper by subjecting the ores initially to a roast in the presence of sodium or calcium chloride. U.S. Pat. No. 589,959 discloses a process of treating copper sulfides to recover gold and/or silver by an initial roasting step with sodium chloride, then leaching with an oxidizing solution of sodium chloride acidulated with sulfuric acid with the result that silver and gold are converted into soluble chlorides from which they can be recovered. U.S. Pat. No. 4,266,972 discloses a procedure wherein metal sulfide ores are leached with water under low pressure to dissolve zinc and copper and hydrolize iron to hematite and leave lead and precious metals as insoluble sulfates. The precious metals may then be removed by leaching with sodium chloride and calcium chloride.

In addition, free chlorine gas has been used to convert precious metals to their chlorides for recovery. References of this type include U.S. Pat. Nos. 75,293, 1,368,885, 138,500, 607,287, 629,856, 674,594, 927,046, 1,185,817, 1,818,846, 3,880,653, and 3,975,189.

The present invention provides a method by which elemental gold may be recovered from sulfur containing mixtures including mixtures obtained from the hydrometallurgical processing for copper recovery.

SUMMARY OF THE INVENTION

It is accordingly one object of the present invention to provide methods for the recovery of gold from its mixture with other minerals.

A further object of the invention is to provide a method for the recovery of gold values from mixtures of gold contained in admixture with other minerals including sulfur.

A still further object of the present invention is to provide a method for the recovery of gold values from residues obtained from the hydrometallurgical processing of minerals to recover copper.

An even further object of the present invention is to provide a method for the recovery of gold values from residues obtained from hydrometallurgical processes which contain sulfur and copper and other materials under conditions of high chlorinity.

Other objects and advantages of the present invention will become apparent as the description thereof proceeds.

In satisfaction of the foregoing objects and advantages there is provided by this invention methods for the recovery of the gold values from mixtures thereof with sulfur which comprises the following steps:

(a) forming an aqueous suspension of the mixture containing the gold and sulfur values;

(b) increasing the chloride concentration of the aqueous suspension so that the suspension contains at least about 12% by weight of chloride;

(c) maintaining the oxidation reduction potential of the mixture in the range of about 650–750 millivolts and a temperature of about from room temperature to about 106° C.;

(d) adding a chloride of a metal such as copper or iron, preferably cupric chloride, and permitting the gold to dissolve into the solution over a period of time; and (e) recovering the gold from the solution, e.g. in an electrolytic cell or by adsorption on carbon.

Also provided by the present invention is a method for the recovery of gold values from mixtures obtained from hydrometallurgical processes for the production of copper, said mixtures comprising gold contained in admixture with at least sulfur, the method comprising the following steps:

(a) providing a suspension of the mixture which contains at least the gold and sulfur;

(b) adding sufficient chloride ion to the mixture to raise the chloride concentration to at least about 12% by weight;

(c) adding sufficient oxidizing agent such as chlorine, to maintain the oxidation reduction potential in the range of 650–750 millivolts and at a temperature of from about room temperature to 106° C.;

(d) adding sufficient cupric chloride or ferric chloride to the mixture to cause the gold values to dissolve into the liquids;

(e) separating the resulting mixture into a solids residue and a liquid filtrate;

(f) transferring the liquid filtrate to an electrolytic cell and recovering the gold values at the cathode or recovering the gold by carbon adsorption.

Also provided by the present invention is a continuous circuit wherein the spent catholyte is fed to the anode compartment of the cell where it is oxidized and returned to step (a) and wherein the solids from step (e) are processed by raising the oxidation reduction potential by the addition of chlorine to precipitate additional gold values and then separating solids from the filtrate. The solids residue has then had the copper, gold and chlorides removed, and the filtrate is recycled to the system for reprocessing to recover additional gold values.

BRIEF DESCRIPTION OF THE DRAWINGS

Reference is now made to the drawings accompanying this application wherein.

DESCRIPTION OF PREFERRED EMBODIMENT

Figure 1:
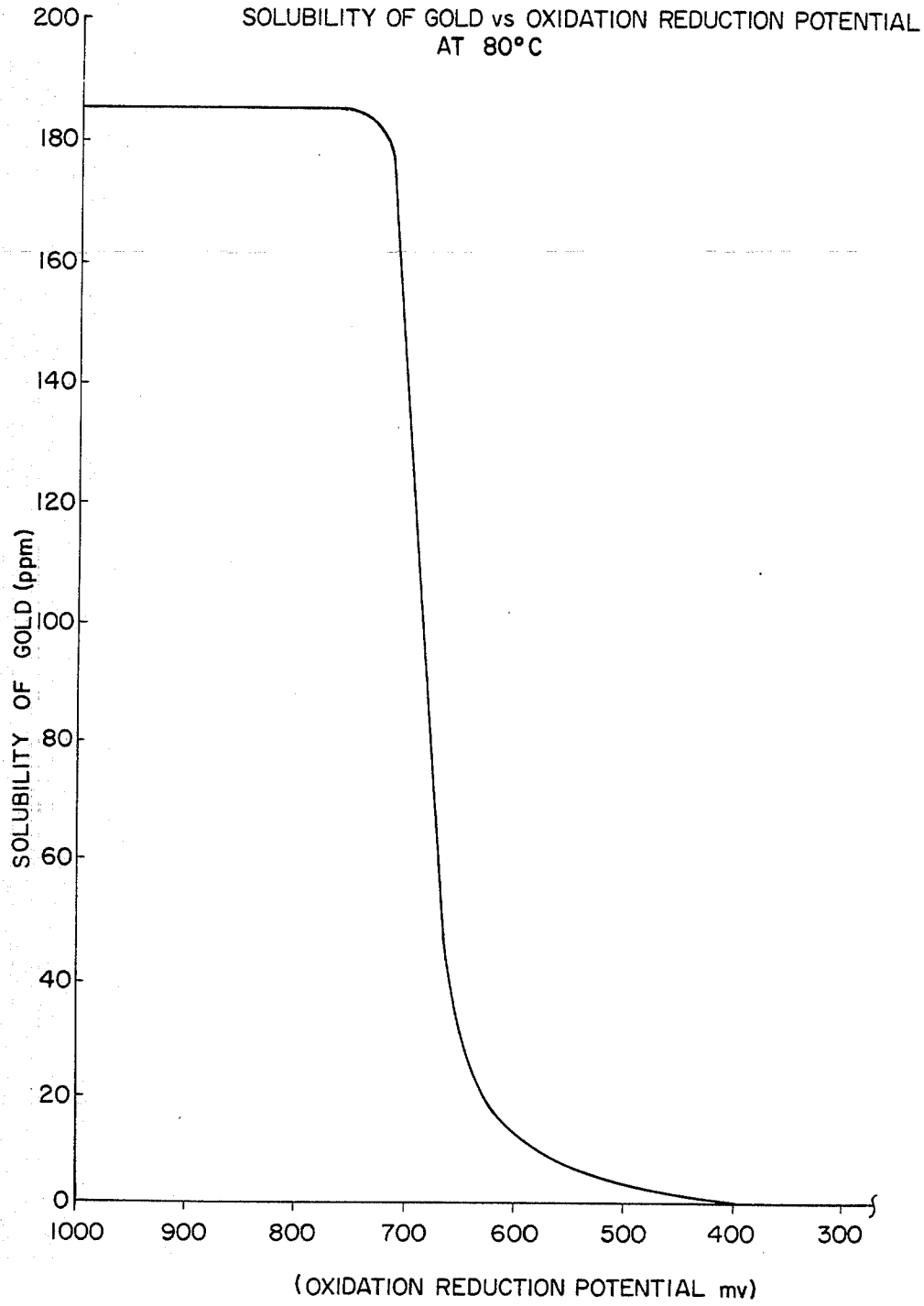
FIG. 1 is a graph which shows the solubility of gold values with respect to the oxidation reduction potential.

As indicated above, this application is concerned with the discovery that gold values can be recovered from mixtures containing the gold even when mixed with other minerals and elements such as sulfur and copper. According to the present invention, it has been discovered that the gold values contained in these mixtures can be recovered in the presence of sulfur by a series of steps which involve critical control of the chloride concentration of the suspension and maintenance of the oxidation reduction potential within a preferred range. The pH of the system should also be near zero and maintenance of these conditions provide a system wherein the gold values contained therein will gradually dissolve into the aqueous portion of the solution from which they can be recovered by electrolytic techniques, usually in the cathode portion of an electrolytic cell.

In the invention described below solutions of unusually high ionic strength and unusual acidity are used. It has been found convenient to express pH or acidity and oxidation/reduction potentials in a way not commonly used. The usual way of measuring pH and redox potential is to measure the electrical potential between a glass electrode (or in redox measurements a platinum electrode) and a calomel electrode. Calomel electrodes are not stable in the systems used in this work so that Ag/AgCl reference electrodes were used. Thus, acidity is measured as the electrical potential (in millivolts) between a glass electrode and a silver/silver chloride electrode and is called pHE. The oxidation/reduction potential of the solution is measured as the electrical potential in millivolts between a platinum electrode and a Ag/AgCl electrode and is called oxidation reduction potential or ORP. This redox scale is about 250 mv different from the more conventionally used Eh scale. The present invention is particularly applicable to the recovery of gold values which are contained in residues resulting from hydrometallurgical processes. Methods of this type primarily involve, for example, the recovery of cuprous chloride from process solutions with subsequent reduction to produce and recover copper metal. U.S. Pat. Nos. 3,798,026, 3,901,776, 3,972,711, 4,039,324, and 4,013,457 illustrate systems of this type. Significant work in this field may be found in U.S. Pat. Nos. 3,785,944 and 3,879,272 to Atwood et al. U.S. Pat. No. 3,972,711 claims an improvement over the Atwood patents. This process generally comprises a hydrometallurgical process for pollution free recovery of metallic copper from copper ores such as chalcopyrite. The process of the present invention is particularly suitable to the recovery of gold values from residues obtained from the hydrometallurgical process of the Atwood patents.

U.S. Pat. No. 3,785,944 describes a basic hydrometallurgical process for processing sulfide ore concentrates, especially those which contain chalcopyrite. The process as described in this patent has four basic stages:

an oxidation stage in which copper containing materials are oxidized with a solution containing ferric chloride and cupric chloride to form a solution containing ferrous chloride and cuprous chloride;

a reduction stage in which any remaining cupric chloride in the solution from the oxidation stage is reduced to cuprous chloride, preferably by use of fresh cement copper;

a copper recovery stage in which metallic copper is recovered from the cuprous chloride solution, preferably by electrolysis;

and a regeneration-purge stage in which ferric chloride and cupric chloride are regenerated by oxidation with concurrent purge of excess iron as well as sulfate, iron and other impurities. The resulting leached solution is then used to oxidize additional copper containing ore.

U.S. Pat. No. 3,879,272 to the same inventors is an improvement over the process of U.S. Pat. No. 3,785,944 and includes combining the oxidation and regeneration-purge stage with the use of KCl in the system. In this patent the reduced leach solution or electrolyte, which is subsequently electrolized, contains impurities which are electrolized with the copper and U.S. Pat. No. 3,972,711 improves on this process in that the impurities are removed by crystallizing cuprous chloride from the system to produce a purer grade of copper.

Basically, the chemistry of this process involves initial reaction of copper sulfide containing ores with a leach solution containing cupric chloride and ferric chloride to produce cuprous chloride from the ore, recovery of metallic copper usually by electrolysis and regeneration of the ferric chloride and cupric chloride by oxidation with concurrent purge of excess iron as well as sulfate, iron and other impurities. There is produced in this process a residual product from the oxidation step which comprises generally elemental sulfur, pyrite and various other insoluble constituents including a minor amount of hematite, a major amount of alkali metal jarosite, usually potassium jarosite, and 20–25 weight percent of insoluble sulfur. This residue also contains substantial amounts of gold values which can be recovered economically according to the present invention.

In the present invention it has been discovered that the gold will dissolve in the solution if the chloride concentration is sufficiently high in the mixture and the ORP or oxidation reduction potential is maintained in the correct range. The chlorinity of the mixture should range from at least about 12% by weight and preferably will range from about 12 to 47 weight percent, and, more preferably, about 22 to 30 weight percent. The oxidation reduction potential (ORP) for the mixture should range from about 650 to 750 millivolts.

With respect to other parameters, the temperature of the reacting mixture should range from about room temperature, or 20° C., up to about 106° C., which is the boiling point of the saline solutions used in the experiments of the invention. The pH of the mixture should be very low and preferably will be about zero.

The starting mixture which contains the gold values may be any desired mixture, but, as pointed out above, preferably is a residue obtained from a hydrometallurgical process. Such residues usually contain sulfur, as well as various other impurities, including copper, perhaps some chloride, and other materials. The invention, however, is also applicable in such areas as the recovery of gold values from scrap materials, such as defective circuit boards and other scrap material from the electronics industry. It is preferred, however, that the starting material be a residue obtained from the hydrometallurgical processing of copper ores and particularly the residue obtained as a result of the practice of the process described in U.S. Pat. Nos. 3,785,944 and 3,879,272. This residue also contains alkali metal chlorides, as well as copper chlorides, in the mixture, and these materials can be used as in situ reactants to assist in recovery of the gold values. CLEAR plant residue (CPR) is produced commercially by Duval Corporation in the CLEAR process.

Regardless of the source of the starting material, it is initially suspended as an aqueous mixture without the necessity for removal of any impurities therefrom. In preferred systems, as with use of a residue from a hydrometallurgical process, the residue is recovered from the plant and is already wet with liquor which contains copper, usually as the chloride and iron chlorides. The copper is preferably present as cupric chloride as this is a particularly desirable material to assist in the recovery of gold values according to the method of this invention. There should be at least enough liquor or liquid present to provide a suspension of the material so that agitation can be carried out without substantial difficulty. If necessary, water or other liquids from the process may be added to provide a suspension of the residue in an agitation tank. In one embodiment of the invention as described hereinafter, the liquids may be recycled liquids obtained in the process after removal of the gold values. In the agitation tank, the suspension is agitated at a temperature of about 20° to 106° C. and preferably at about 40° to 80° C. and a chloride concentration of at least above about 12% by weight is obtained. Because many residues already contain substantial amounts of chloride, it is possible that the chloride concentration could already be in the correct range. However, if not, a sufficient amount of a chloride salt should be added to the mixture to raise the chlorinity of the solution. The source of chloride is preferably either an alkali metal salt or an alkaline earth metal salt although other materials can be used, such as ferric chloride and ferrous chloride. Preferred salts include sodium chloride, potassium chloride, or magnesium chloride, or mixtures, since these salts can often be obtained as natural mixtures. A sufficient amount of one or more salts is added until the chloride concentration is at least above about 12 weight percent, e.g., about 12 to 47 weight percent, and preferably will range from about 22 to 30 weight percent.

It is also preferred that the pHE of the system be in the range of about 400 to 550 millivolts. A pHE of about 450–500 mv is especially preferred. If additional acid is required, the addition of hydrochloric acid is preferred.

It is also important that the oxidation reduction potential, or ORP, be in the proper range to enable the gold values to dissolve into the aqueous portion of the solution. It has been found according to the present invention that the oxidation reduction potential should be in the range of about 650–750 millivolts. The oxidation reduction potential is conveniently raised to the desired level by the addition of an oxidizing agent such as chlorine, bromine or hydrogen peroxide. The use of chlorine gas is a satisfactory method of raising the oxidation reduction potential. With regard to this point, reference is now made to FIG. 1 accompanying the application, which is a graph showing the solubility of gold at 80° C. With respect to the oxidation reduction potential of the solution. As will be noted, the gold becomes soluble in the range of about 650–750 millivolts, and this represents a highly preferred embodiment of the present invention. It should be noted with respect to the oxidation reduction potential that it should be as high as possible in order to dissolve the gold values. However, it should not be sufficiently high to attack the sulfur present which will take place if the ORP rises much above 750 millivolts.

It is also necessary that the suspension or solution have an acid pH below 0. A pHE of about 450–460 mv is especially preferred. Above a pH of 0, undesirable materials (e.g., jarosites) can be deposited on the gold particles impeding the rate of dissolution. Normally, if the suspension or solution is obtained from a hydrometallurgical processing plant, there will be sufficient chloride and/or sulfate ions present to provide the necessary acid pH. Further, the low pH can frequently be maintained by the acid produced by the slow oxidation of other sulphides in the system (e.g., $CuFeS_2$ and pyrite). If required, however, a small amount of hydrochloric acid may be added to reduce the pH of the mixture to the desired values. The process is essentially: (1) the addition of a chloride of a metal such as copper or iron to the suspension containing the gold, (2) raising the chlorinity of the system by the addition of some suitable metal chloride, and (3) the adjustment of the pH and ORP to the levels necessary to cause the gold values to dissolve into the aqueous portion of the mixture at a suitable rate. It was found that raising the chloride level in solution greatly enhanced the oxidizing ability of the cupric ion. At high chloride level, cupric copper became a sufficiently good oxidizing agent even to oxidize gold metal. This is presumably because the redox potential depends on the $CU^{++}/CU^{+}$ ratio and $Cu^{+}$ is more strongly complexed by chloride ions than is $Cu^{++}$. It has been unexpectedly discovered that, provided the ORP is controlled, either ferric chloride or cupric chloride are particularly suitable to cause the gold to dissolve into the solution leaving the sulfur suspended in the solution untouched.

The amount of cupric chloride or ferric iron which should be added or maintained in the system can range from 1 percent up to saturation, but preferably will broadly range from about 3.5 weight percent up to about 27.0 weight percent. Preferred concentrations range from about 3.5 to 12 weight percent, and, more preferably, from about 4.0 to 8.0 weight percent. About 5 weight percent is preferred for a residue from the CLEAR process.

Figure 2:
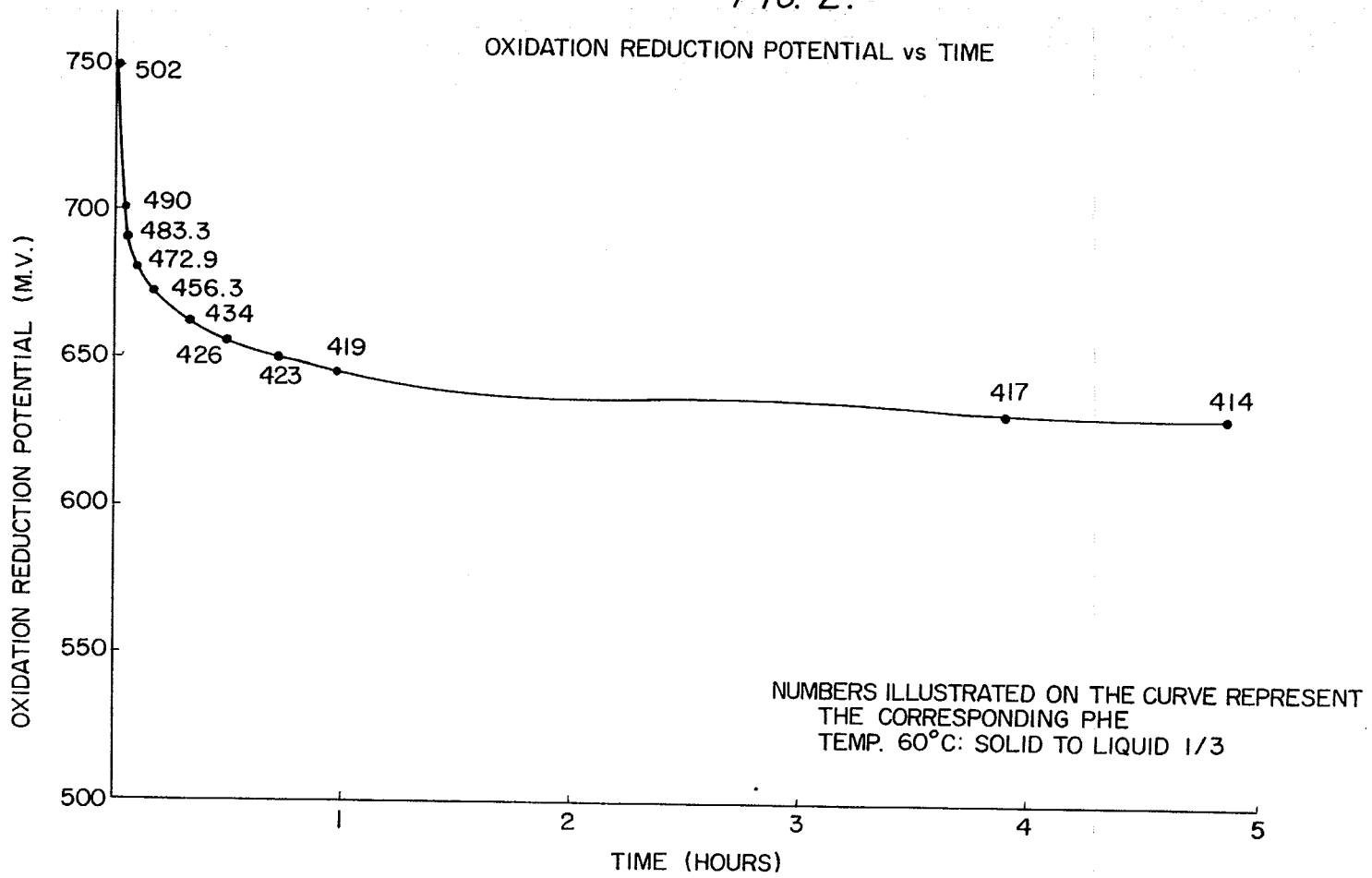
FIG. 2 is a graph which shows the dissolution rate of gold with respect to the concentration of iron in the preferred system.

Reference is made to FIG. 2 which is a graph illustrating the rate of dissolution of gold in microns per hour relative to the concentration of Fe as $FeCl_3$ in a saturated solution of NaCl at 80° C. and a pHE of 450 mv. From the graph, it will be seen that higher dissolution rates of gold occur in this system at Fe concentrations of about 3.5 to 12 weight percent.

The gold is oxidized by the cupric (or ferric) ions and goes into solution as $AuCl_4^-$ thus:

$$Au^\circ + 3Cu^{++} + 6Cl^- \rightarrow AuCl_4^- + 3Cu^+ + 2Cl^-$$

from which it may be recovered as described hereinafter. It has also been found that improved results are obtained if the gold values are of small particle size, such as fines.

After the cupric chloride or ferric chloride has been added and the gold has dissolved in the solution of the mixture, the gold values may then be recovered, preferably in an electrolytic cell or by adsorption on carbon. Recovery may also, however, be by the addition of a metal, such as copper, to lower the ORP of the solution. Alternatively, the gold may be removed from solution by reaction with carbon. A preferred process of the present invention, however, is to recover the gold as crystals precipitated onto the cathode of an electrolytic cell. After recovery of the gold values, the resulting solution or mixture obtained after removal of the gold values may be recycled for reuse in the system, especially the processing liquors.

Figure 3:
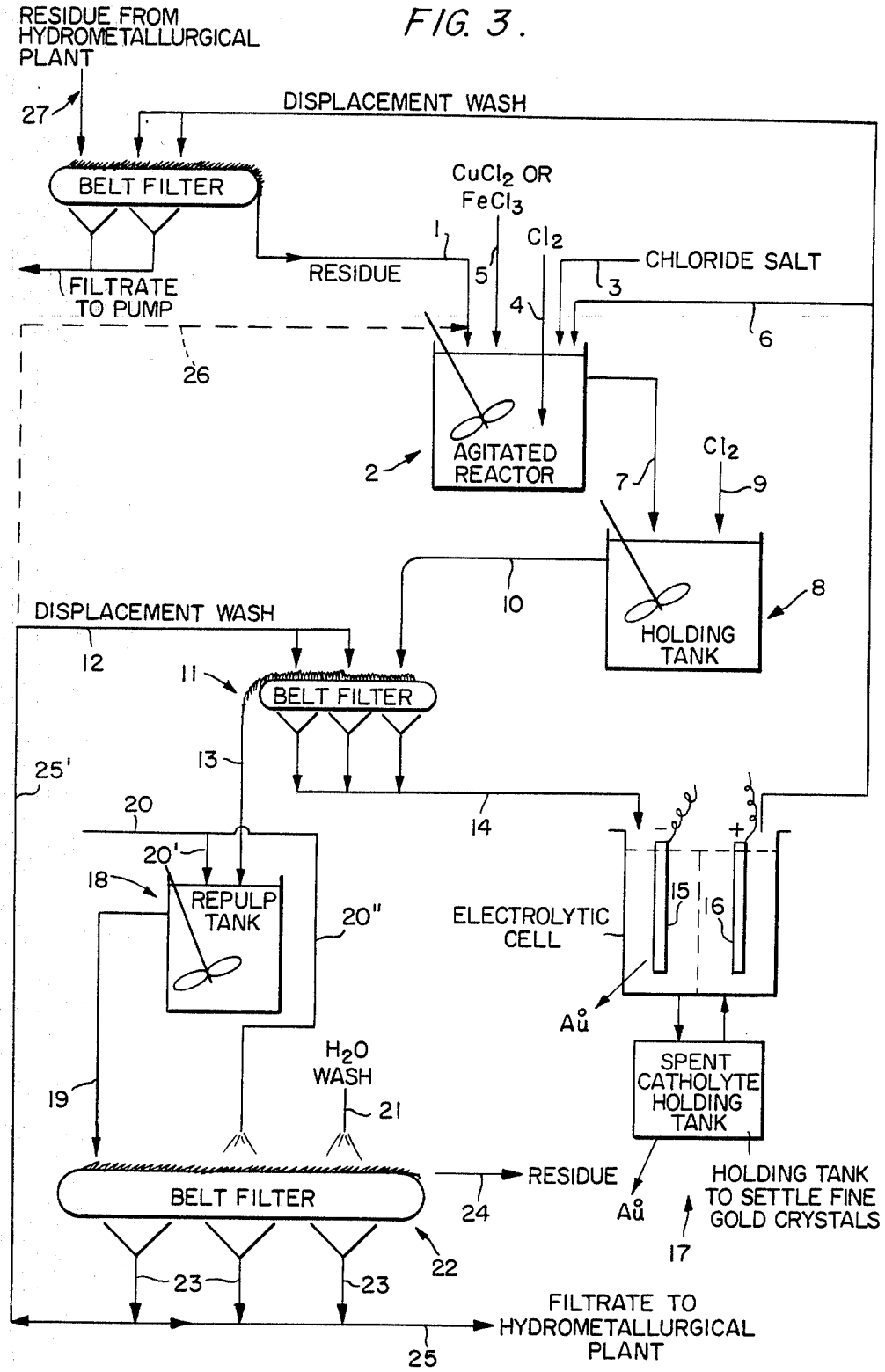
FIG. 3 is a flow chart of the preferred embodiment of the invention for the recovery of gold from a hydrometallurgical process residue.

Reference is now made to FIG. 3 accompanying the present application, which represents a flow sheet of a continuous process for the recovery of gold values from a residue obtained from the hydrometallurgical process from which copper has been recovered. The particular residue which was treated in the process of FIG. 3 is the residue obtained from the process practiced according to U.S. Pat. No. 3,785,944, as discussed above. As indicated there, this residue is obtained from the oxidation step of the procedure and generally contains elemental sulfur, pyrite, and various other insoluble constituents, including hematite, a major amount of alkali metal jarosite, usually potassium jarosite, and 20 to 25 weight percent of insoluble sulfur. The residue also contains substantial amounts of gold values.

As shown in FIG. 3, the residue from the hydrometallurgical plant (HMP) is introduced by line 1 into agitated reactor 2. The residue will be obtained from filter 27 and has been subjected to a displacement wash with anolyte liquor from the gold recovery cell which has been passed through a carbon bed to reduce the contained gold to very low levels. Make-up processing liquor may be added as necessary by line 26. In agitated reactor 2, a sufficient amount of a chloride salt, such as sodium chloride, is added by line 3 to raise the chlorinity of the mixture to at least 12 percent by weight. In addition, chlorine gas is added to the reactor by line 4 to raise the oxidation reduction potential value to at least 650 millivolts or as high an oxidation reduction potential as necessary but not sufficiently high to oxidize the elemental sulfur present in the residue. The temperature at this stage should be as high as possible to obtain a high gold dissolution rate. A preferred temperature range is 50° to 80° C. The density in reactor 2 should be as high as possible so as to maintain a good filtering condition and to minimize equipment requirements. A solids content of about 25 percent is satisfactory when processing the residue from the CLEAR process.

In the case of the CLEAR process, the residue from line 1 which is fed into agitated reactor 2 will already contain sufficient cupric chloride plus some ferric chloride in amounts which will cause the gold contained in the mixture to dissolve into the solution. If the residue in line 1, however, does not contain cupric or ferric chlorides as chlorides in situ, the additional required amounts, up to 3.5 to 5 weight percent, may be added through line 5 to agitated reactor 2. As discussed above, the cupric chloride or ferric chloride serves to cause the gold to dissolve into the solution.

From agitated reactor 2, the reacting mixture is passed by line 7 to holding tank 8. Holding tank 8 is included in the system in order to prevent shortcircuiting in the system and to maintain good flow in the system. In addition, in holding tank 8, the chlorinity pH, or the amount of cupric chloride or ferric chloride, may be adjusted as necessary. As shown in FIG. 3, additional chlorine may be added through line 9 to maintain the oxidation reduction potential of the mixture. It should also be noted that neither of agitated reactor 2 nor holding tank 8 show the addition of an acid to lower the pH to about 0. This is because the residue and liquor being treated as described already has sufficient acid present to be at the proper pH. However, HCl could be added at this point if necessary.

The total residence time in both agitated reactor 2 and holding tank 8 will range from about 2 to 8 hours, depending on the particle size of the gold to be dissolved. Residence time, of course, may be increased over a wide range to ensure that all the gold is solubilized.

From holding tank 8, the mixture is passed by line 10 to filter 11, from which a residue is obtained at line 13 after a displacement wash from line 12 and a filtrate is obtained at line 14. The filtrate contains the dissolved gold values and is passed by line 14 to an electrolytic cell for gold recovery. The gold is recovered by deposition of metallic gold crystals onto the cathode 15, which then fall off to be collected from the bottom of the cathode compartment or from the bottom of the spent catholyte holding tank 17. Any gold that adheres to the cathode can be periodically removed. The spent catholyte is fed to the spent catholyte holding tank and hence to the anode compartment of the electrolytic cell which contains anode 16 wherein it is oxidized. It is then recycled by line 6 to agitated reactor 2 for reuse in the system to repulp additional incoming residue from line 1, thus serving as process liquors for the mixture. Part of the stream is passed via line 6' through a carbon bed 30 which removes any contained gold and is used to displace liquor from the incoming feed as it is being filtered on belt filter 27.

The residue or filter cake in line 13 from filter 11 is repulp tank 18 with liquor which has been recovered from the final belt filter 22. This liquor is passed by line 25 through a carbon bed (to remove any gold) and thence by line 25'' into repulp tank 18. The liquor in repulp tank 18 has its oxidation reduction potential maintained in the desired range of 650 to 750 millivolts by the addition of chlorine via line 28 so that any gold in the entrained solution will not precipitate. The purpose of this repulp tank 18 is to permit the recovery of gold which is dissolved in the liquor entrained in the filter cake from filter 11. From repulp tank 18 the pulp is passed by line 19 to belt filter 22. The filter cake on belt filter 22 is first washed with chlorine water or preferably liquor from the hydrometallurgical process which is passed by line 20 from filter 27. This liquor has had its oxidation reduction potential raised to the desired range of 650 to 750 millivolts by the addition of chlorine so that any gold in the solution entrained in the filter cake will not precipitate. The filter cake is then washed on the belt filter with water from line 21. These washings with their contained chlorides and traces of gold are then recovered at 23 and returned to the hydrometallurgical plant (HMP) by line 25. The filtrate from belt filter 22 and, if necessary, a portion of the leach liquor washings are first passed through a carbon bed via line 25 to remove any traces of gold and then returned by line 25' as a displacement wash for belt filter 11. The ORP of this stream must be maintained in the desired range of 650 to 750 millivolts by the addition of chlorine, if necessary. Another portion is returned by line 25'' to repulp the filter cake from belt filter 11. Make-up liquor may be passed by line 26 as necessary to the agitated reactor 2. The carbon in carbon beds 30 and 31 are processed periodically to recover any contained gold.

The residue obtained from the belt filter at line 24 will comprise a residue from which the copper, gold, and chlorides have been removed.

The flowsheet shown in FIG. 3 is designed with the view of preventing gold from escaping the system with the final residue. It is either returned to the primary gold recovery circuit or as a last resort to the hydrometallurgical process from which it will ultimately be recovered. A further point of the design of the flowsheet is to minimize the flow of liquor into and out of the primary circuit to maintain the gold concentrations as high as possible in the primary circuit. This is done by displacement washes on the filters Both these considerations enable efficient recovery of gold from residues of even the lowest gold content.

It will, therefore, be seen that the process of the present invention provides a system wherein gold values may be economically recovered from residues from which the gold has not been recovered heretofore. In addition, copper and iron values which are contained in situ in these residues can be used to assist in recovery of the gold.

A particularly favorable situation exists in treating hydrometallurgical residues by this process. In any real mineral concentrate, or hydrometallurgical residue, the gold metal is extremely finely divided and thus presents a very large surface area. Other reactive materials such as pyrite occur as crystals which are many orders of magnitude larger in size. Thus a few microns of gold dissolved would represent a large percentage of the gold present, whereas a similar attack on the pyrite crystals would represent a negligible amount of pyrite dissolved.

The following examples are presented to illustrate the invention, but it is not to be considered limited thereto. In the examples and throughout the specification, parts are by weight unless otherwise indicated.

EXAMPLE 1

A total of 968 grams of overflow process liquids recovered from the second stage of the hydrometallurgical processing plant described in U.S. Pat. No. 3,785,944 was heated to 65° C. and then saturated with sodium chloride. The pH was adjusted to −1.5 by the addition of hydrochloric acid. Chlorine gas was then bubbled into the solution to bring the oxidation reduction potential to 946 mv (measured with respect to a Ag/AgCl electrode). Then 18 grams of elemental sulfur was added, at which time the oxidation reduction potential dropped to a steady value of 782 mv after about 45 minutes. Thereafter, 247 grams of residue from the hydrometallurgical plant were added together with a piece of gold weighing 3.655 mg. The oxidation reduction potential was then held at 750±10 mv by the addition of chlorine gas for 3 hours, during which time the temperature was held at between 60° and 65° C. The pHE was held between 493 and 508 mv with the addition of hydrochloric acid. At the end of 3 hours, the piece of gold was recovered. It weight 2.915 mg., representing a loss of 13.6 microns, or 4.5 microns per hour.

This experiment was designed to illustrate that the gold will dissolve at a significant rate in the presence of elemental sulfur and at high chlorinity and at an oxidation reduction potential at which sulfur is not attacked.

EXAMPLE 2

A solution was made up from magnesium chloride, cupric chloride, and water. The solution was heated to 80° C. and the pHE adjusted to 525 mv with a small quantity of HCl. The solution was analyzed and contained 3.91% $Cu^{++}$and 27.66% $Cl^{-}$. The ORP was measured and found to be 702 mv. A small piece of gold (3.512 mg) was placed in the solution. After 3 hours it was removed and weighed. It was found that 0.236 mg had dissolved giving a dissolution rate of 2.35 microns/hr.

This experiment was designed to illustrate that pure cupric copper is an effective solvent for gold if present in solutions of high chlorinity.

EXAMPLE 3

A concentrate obtained from the Battle Mountain copper area of Nevada, which is mostly chalcopyrite, was found to contain 1.5 ounces of gold per ton. From this mixture was prepared a residue in accordance with the process of U.S. Pat. No. 3,785,944.

Overflow liquor in the amount of 300 grams was obtained as second stage overflow from the process of U.S. Pat. No. 3,785,944, and sufficient sodium chloride was added (13 grams) to ensure saturation. The mixture was then heated to 60° C., and the pHE was adjusted to 490 mv with hydrochloric acid. The oxidation reduction potential was then raised to 1020 mv by bubbling chlorine gas into the liquor. Three grams of elemental sulfur were then added to ensure that free sulfur was present in the mixture. This lowered the oxidation reduction potential to 730 mv. This required 2 hours, and the sulfur would not oxidize below this oxidation reduction potential. Then 83.2 grams of the Battle Mountain residue prepared as descrribed above was added to the mixture, and the pHE and oxidation reduction potential were maintained at 490±4 mv and 714 to 730 mv, respectively, for 3 hours. The product was then filtered and the filtrate assayed for gold.

The filter cake was washed with water which had had its oxidation reduction potential adjusted to 730 mv with chlorine. The filter cake was assayed for gold. The results showed that 95 percent of the gold was solubilized.

EXAMPLE 4

This is an experiment to compare the dissolution rate of the gold using ferric ions as compared to the use of cupric ions.

In this experiment, second stage overflow from the process of U.S. Pat. No. 3,785,944 was obtained and the copper removed by cementation with aluminum foil. Then, to 469.7 grams of this material, containing 1.6 percent iron, was added 20.79 grams of sodium chloride, the mixture heated to 60° C., and the pHE adjusted to 1060 mv by the addition of chlorine gas. Then, 8.5 grams of elemental sulfur was added, and the oxidation reduction potential followed until it stabilized at 730 mv. There was then added a piece of gold weighing 3.759 mg and 150 grams of the residue obtained from the hydrometallurgical process of U.S. Pat. No. 3,785,944. The oxidation reduction potential was maintained between 707–729 mv and the pHE at 486–495 mv, for 2½ hours at 60° C. The rate of dissolution of gold was found to be 1.3 microns of gold per hour. It was concluded from this experiment that ferric ions dissolve gold at much the same rate as copper ions and both the rate of dissolution and the oxidation reduction potential below which elemental sulfur does not oxidize appreciably are comparable.

EXAMPLE 5

Using the flow scheme described in FIG. 2 accompanying this application, residue which contained jarosite, ferric hydroxide, hematite, elemental sulfur, as well as gold values, is obtained from the process of U.S. Pat. No. 3,785,944. This residue is mixed with recycle liquor and recycle liquor wash in an agitated vessel to which sufficient sodium chloride is added so as to obtain sodium chloride saturation. The temperature in the agitated reactor is 60° C., and sufficient chlorine gas is added to raise the oxidation reduction potential to 730 mv. The pHE is 500 mv. This reacting mixture is then passed to a holding vessel, where additional chlorine is added at 60° C. to maintain the oxidation reduction potential at 700 mv, with the pHE at 500 mv. This mixture contained sufficient cupric chloride and some ferric chloride to maintain the cupric copper or ferric iron concentrations at 3.5 to 5 percent by weight. After a period of 2 hours in the holding vessel, the mixture is filtered. The filtrate is then passed to an electrolytic cell, from which gold crystals are deposited in the cathode compartment of the cell. The gold crystals are then collected from the bottom of the cathode compartment. The spend catholyte is then fed to the anode compartment, where it is oxidized and recycled to the agitated vessel.

The filter cake from the filter is repulped with chlorinated liquor from the leach liquor stream of the hydrometallurgical process, where oxidation potential is raised to 700 mv by the addition of chlorine to prevent the precipitation of gold. The pulp from this tank is then fed to a filter, where the residue is then washed with chlorinated liquor followed by a water wash so that a residue is recovered from the filter, from which the gold, copper, and chlorides are removed. The filtrate from the filter, which includs the leach liquor wash and water wash, is then recovered as filtrate. A portion is recycled as a wash to displace much of the liquor originally associated with the incoming residue and for reuse in the system to recover any additional gold present.

The invention has been described herein with reference to certain preferred embodiments. However, as obvious variations thereon will become apparent to those skilled in the art, the invention is not to be considered as limited thereto.

What is claimed is:

1. A method for the recovery of gold values from ore mixtures thereof which contain gold in admixture with sulfur, which method comprises the following steps:

(a) forming an aqueous suspension of the ore mixture containing the gold and sulfur values;

(b) raising the chloride concentration of the suspension by the addition of a member selected from the group consisting of an alkali metal chloride, an alkali earth metal chloride, and mixtures thereof, so that the suspension contains about 12 to 47 weight percent of chloride;

(c) adding an oxidizing agent to the suspension in sufficient amounts to raise the oxidization reduction potential of the suspension to the range of about 650–750 millivolts, said oxidation reduction potential (ORP) being measured as the electrical potential in millivolts between a platinum electrode and a silver/silver chloride electrode, said oxidation reduction potential being insufficient to attack sulfur contained in the suspension;

(d) maintaining the acidity (pHE) of the mixture in the range of from 400 to 550 millivolts, measured as the electrical potential in millivolts between a glass electrode and a silver/silver chloride electrode, said acidity being a pH of below 0;

(e) adding 3.5 to 27 weight percent of cupric chloride or ferric chloride to said suspension to oxidize the gold and cause the gold contained in the ore mixture to dissolve into the solution separated from the sulfur; and (f) recovering the gold from the solution.

2. A method according to claim 1 wherein the ore mixture containing the gold values and sulfur is a mixture obtained from the hydrometallurgical processing of copper.

3. A method according to claim 1 wherein the chloride concentration is maintained in the range of about 12–38 weight percent.

4. A method according to claim 1 wherein the oxidation reduction potential is raised by the addition of chlorine gas.

5. A method according to claim 1 wherein the pH of the suspension is lowered by the addition of hydrochloric acid.

6. A method according to claim 1 wherein the gold values are recovered from the suspension by deposition of crystals of the gold on the cathode of an electrolytic cell.

7. A method according to claim 1 wherein the gold values are recovered by adsorption on carbon.

8. A method according to claim 1 wherein the gold values are recovered by reducing the ORP of the solution with an electric current or by the addition of copper metal as a reducing agent.

9. A method for the recovery of gold values from ore mixtures obtained from hydrometallurgical processes for the production of copper, said mixtures comprising gold values contained in admixture with at least elemental sulfur, the method comprising the following steps:

(a) forming an aqueous suspension of the mixture which contains at least the gold and sulfur values;

(b) adding sufficient alkali metal salt, alkaline earth metal salt or mixtures thereof to the suspension to raise the chloride concentration to the range of about 12 to 47 percent by weight;

(c) adding an oxidizing agent to the suspension in sufficient amounts to raise the oxidation reduction potential of the suspension to the range of 650–750 millivolts, said oxidation reduction potential (ORP) being measured as the electrical potential in millivolts between a platinum electrode and a silver/silver chloride electrode, said oxidation reduction potential being insufficient to attack sulfur contained in the suspension;

(d) maintaining the temperture of the suspension in the range of from about room temperature to about 106° C.;

(e) maintaining the acidity (pHE) of the mixture in the range of from 400 to 550 millivolts, measured as the electrical potential in millivolts between a glass electrode and a silver/silver chloride electrode, said acidity being a pH of below 0;

(f) adding 3.5 to 27 weight percent of cupric chloride or ferric chloride to said suspension to oxidize the gold and cause the gold contained in the ore to dissolve into the solution separated from the sulfur; and (g) separating the resulting mixture into a solids residue and a liquid filtrate; and;

(h) transferring the liquid filtrate to an electrolytic cell and recovering the gold values at the cathode.

10. A method according to claim 9 wherein spent catholyte from the cell is fed to the anode compartment of the cell, where it is oxidized and then recycled for mixing with entering filtrate.

11. A method according to claim 9 wherein the solids from the filtration step are processed by repulping with recycle liquor, which has had its oxidation reduction potential raised by the addition of an oxidizing agent to prevent precipitation of gold values, separating the solids from the filtrate and recycling the filtrate to the system.

12. A method according to claim 9 wherein the chloride concentration is maintained in the range of about 12–30 weight percent.

13. A method according to claim 9 wherein the chloride concentration is raised by the addition of sodium chloride, potassium chloride, magnesium chloride or mixtures thereof.

14. A method according to claim 9 wherein the oxidation reduction potential in the mixture is raised by the introduction of chlorine gas as an oxidizing agent.

15. A method according to claim 9 wherein about 3.5 to 12.0 weight percent of copper as cupric chloride is added to the mixture to effect dissolution of gold.

16. A method according to claim 9 wherein about 3.5 to 12.0 weight percent of iron as ferric chloride is added to the mixture to effect dissolution of the gold values.

* * * * *